US006688380B2

(12) United States Patent
Lavochkin et al.

(10) Patent No.: US 6,688,380 B2
(45) Date of Patent: Feb. 10, 2004

(54) CORRUGATED FIN HEAT EXCHANGER AND METHOD OF MANUFACTURE

(75) Inventors: Ronald B. Lavochkin, Bow, NH (US); Bradley R. Whitney, Boscawen, NH (US)

(73) Assignee: Aavid Thermally, LLC, NH (US)

( * ) Notice: Subject to any disclaimer, the term of this patent is extended or adjusted under 35 U.S.C. 154(b) by 0 days.

(21) Appl. No.: 10/185,652

(22) Filed: Jun. 28, 2002

(65) Prior Publication Data

US 2004/0000396 A1 Jan. 1, 2004

(51) Int. Cl.[7] ..... F28D 1/00
(52) U.S. Cl. ..... 165/150; 165/183; 29/890.047
(58) Field of Search ..... 165/150, 151, 165/152, 181, 183; 29/890.03, 890.047

(56) References Cited

U.S. PATENT DOCUMENTS

| | | | | | |
|---|---|---|---|---|---|
| 1,793,123 | A | * | 2/1931 | Murray, Jr. | 165/151 |
| 1,886,498 | A | * | 11/1932 | Phelps | 165/151 |
| RE19,781 | E | * | 12/1935 | Murray | 165/151 |
| 2,119,761 | A | * | 6/1938 | Wentworth | 165/150 |
| 2,195,259 | A | * | 3/1940 | Ramsaur | 165/150 |
| 3,407,874 | A | * | 10/1968 | Gier, Jr. | 165/150 |
| 3,780,799 | A | * | 12/1973 | Pasternak | 165/151 |
| 4,041,594 | A | | 8/1977 | Chartet | 29/157.3 |
| 4,327,800 | A | | 5/1982 | Miller | 165/79 |
| 4,330,035 | A | | 5/1982 | Hillerstro | 165/164 |
| 4,434,846 | A | | 3/1984 | Lu | 165/161 |
| 4,778,004 | A | | 10/1988 | Paulman et al. | 165/150 |
| 5,107,575 | A | | 4/1992 | Ishida et al. | 29/89.048 |
| 5,111,876 | A | | 5/1992 | Nash | 165/151 |
| 5,253,702 | A | | 10/1993 | Davidson et al. | 165/80.4 |
| 5,311,935 | A | | 5/1994 | Yamamoto et al. | 165/152 |
| 5,329,993 | A | | 7/1994 | Ettehadieh | 165/104.14 |
| 5,564,497 | A | | 10/1996 | Fukuoka et al. | 165/152 |
| 5,706,169 | A | | 1/1998 | Yeh et al. | 361/690 |
| 5,787,972 | A | | 8/1998 | Beamer et al. | 165/152 |
| 5,797,448 | A | | 8/1998 | Hughes et al. | 165/151 |
| 6,035,927 | A | | 3/2000 | Krauss et al. | 165/135 |
| 6,273,183 | B1 | | 8/2001 | So et al. | 165/109.1 |

FOREIGN PATENT DOCUMENTS

| | | |
|---|---|---|
| JP | 04-174295 | 6/1992 |
| JP | 2000-018729 | 1/2000 |

OTHER PUBLICATIONS

Peter Berkelmans, Flow Transition in Cross–Corrugated Cavities, Oct. 22, 1999.

Clifford C. Wright et al., New, High Efficiency, Low Cost Liquid Heat Exchanger for Cooling Power Semiconductor Devices, 2001.

* cited by examiner

*Primary Examiner*—Temell McKinnon
(74) *Attorney, Agent, or Firm*—Cohen, Pontani, Lieberman & Pavane

(57) ABSTRACT

A heat exchanger includes a corrugated metal sheet comprising a first side having a plurality of first troughs alternating with a plurality of first peaks, and a second side having a plurality of second troughs alternating with a plurality of second peaks, each trough being formed by a pair of walls, each wall separating the first side from the second side and extending from a first peak to a second peak, the troughs and peaks extending in parallel and defining a longitudinal direction. Each first peak is formed with at least one depression, the depressions in respective peaks being aligned to form at least one tube-receiving channel extending transversely to the longitudinal direction. Each depression has a contact surface formed in the first side and extending laterally over each adjacent first trough. A tube section is received in each tube-receiving channel in substantially conforming contact with the contact surfaces. The heat exchanger is manufactured using first and second fixtures having first and second sets of parallel ribs which are received in respective second and first troughs of the corrugated sheet. The first peaks are formed downward using a mandrel received through windows interrupting the second ribs, the depressions being formed in corresponding notches in the first ribs.

6 Claims, 3 Drawing Sheets

CORRUGATED FIN HEAT EXCHANGER AND METHOD OF MANUFACTURE

BACKGROUND OF THE INVENTION

1. Field of the Invention

The invention relates to a heat exchanger of the type comprising a corrugated metal sheet in close contact with tube sections. The invention further relates to a method and an apparatus for manufacturing such a heat exchanger.

2. Description of the Related Art

A corrugated sheet includes a first side having a plurality of first troughs alternating with a plurality of first peaks, and a second side having a plurality of second troughs alternating with a plurality of second peaks. Each trough is formed by a pair of walls, each wall separating the first side from the second side and extending from a first peak to a second peak, the troughs and peaks extending in parallel and defining a longitudinal direction.

Heat exchangers utilizing a corrugated metal sheet in close contact with cooling tube sections are well known. The cooling tube sections are typically soldered to the peaks of the corrugated sheet transversely to the longitudinal direction, as disclosed by U.S. Pat. Nos. 5,564,497 and 6,035,927. It is also known to punch elongate apertures into the sheet prior to corrugating in order to form transverse channels in the peaks for receiving the tube sections, as disclosed in U.S. Pat. No. 4,778,004, and to punch holes in the sheet to provide passages through the walls for the tube sections. While the tube sections typically carry a heat transfer fluid from an object to be cooled, it is also possible that the tube sections are phase change devices known as heat pipes, or even solid metal which simply conducts heat without the use of a heat transfer fluid. The guiding principle in each case is the establishment of close contact between the tube sections and the corrugated metal sheet which dissipates heat from the tube sections.

The prior art suffers from the disadvantage that the contact area between the tube sections and the corrugated sheet is very limited. For example, the tube sections in U.S. Pat. No. 6,035,927 have only point contact with the peaks of the corrugated sheet. The tube sections in U.S. Pat. No. 5,564,497 are formed flat, so that the thermal contact with the peaks is a essentially a line contact. Both of these structures rely heavily on solder to enlarge the path of thermal conduction. Heat exchangers having channels or holes in the corrugations improve the contact area, which is still usually enhanced by solder, but the sheet must be precisely aligned during corrugating, so that the channels or holes are precisely aligned for receiving the tube sections. This adds to the cost of manufacture.

SUMMARY OF THE INVENTION

The object of the invention is to establish heat conducting contact over a large area between the corrugated sheet and the tube sections, without the necessity of providing apertures in the sheet in order to provide channels or holes to accommodate the tube sections in the corrugated sheet, and without the provision of specially shaped tube sections.

According to the invention, this object is achieved by forming each first peak with at least one depression, the depressions in respective peaks being aligned to form at least one tube-receiving channel extending transversely to the longitudinal direction of the peaks and troughs. The channels are typically straight (rectilinear), but may be curved or otherwise routed to accommodate tubing which is formed to maximize heat transfer in a desired area of the corrugated sheet, as may be dictated by the location of components to be cooled. Each depression has a contact surface formed in the first side and extending laterally over each adjacent first trough, the contact surface being profiled to conform closely to a tube section received thereagainst. The contact surface profile is circular when standard round tubing is used, but may be formed to accommodate tubing having other shapes. For example, tubing having an oval cross-section may be used to minimize resistance to airflow by the parts of the tubing sections which stand proud of the peaks. The tube sections can thus be received in the tube-receiving channels with an area of thermal contact which is very large in comparison with the prior art, even before solder is applied. The use of solder or epoxy may therefore be minimized, which reduces the cost of manufacture. The contact surfaces also provide for easy deposition of solder for a reflow process.

The invention also relates to a method of manufacturing the heat exchanger according to the invention. The method utilizes a first fixture comprising a first base and a plurality of parallel first ribs fixed to the base, each first rib having an edge remote from the base and at least one notch extending downward from the edge, the notches being aligned to form at least one forming channel extending transversely of the first ribs. According to the method, a corrugated sheet of the type described above is placed on the first fixture so that the first ribs are received in the second troughs. A mandrel is then used to deform the first peaks downward into the notches to form the depressions which are aligned to form the at least one tube-receiving channel. The mandrel and the notches preferably have circular profiles, so that cylindrical contact surfaces are formed for receiving cylindrical tube sections. Note that the corrugated sheet may also be deformed by other apparatus and methods, such as a rolling ball or a ball end mill. The latter could be wiped across the peaks (XY motion), or could be reciprocated (Z motion) and used as a punch to form depressions in the peaks. In this regard, it is possible to form depressions by vertical movement of a spherically shaped anvil.

In order to stabilize the corrugated metal sheet while the tube-receiving channels are being formed, a second fixture is used. The second fixture includes a second base and a plurality of second ribs fixed to the second base, the second ribs and the second base being interrupted to form at least one window extending through the second fixture. The second fixture is placed onto the first fixture after the corrugated sheet is emplaced on the first fixture, and before forming the first peaks downward into the notches to form the depressions, the second ribs being received in the first troughs and the windows being aligned with the forming channels. The first peaks can then be deformed downward to form the tube-receiving channels by using at least one mandrel received through the windows in the second fixture. The second fixture stabilizes the corrugations against deformation except in the areas immediately adjacent to the notches in the first ribs, whereby peaks of the corrugated sheet are formed downward and laterally into the windows, so that the resulting contact surfaces extend laterally over the adjacent first troughs.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
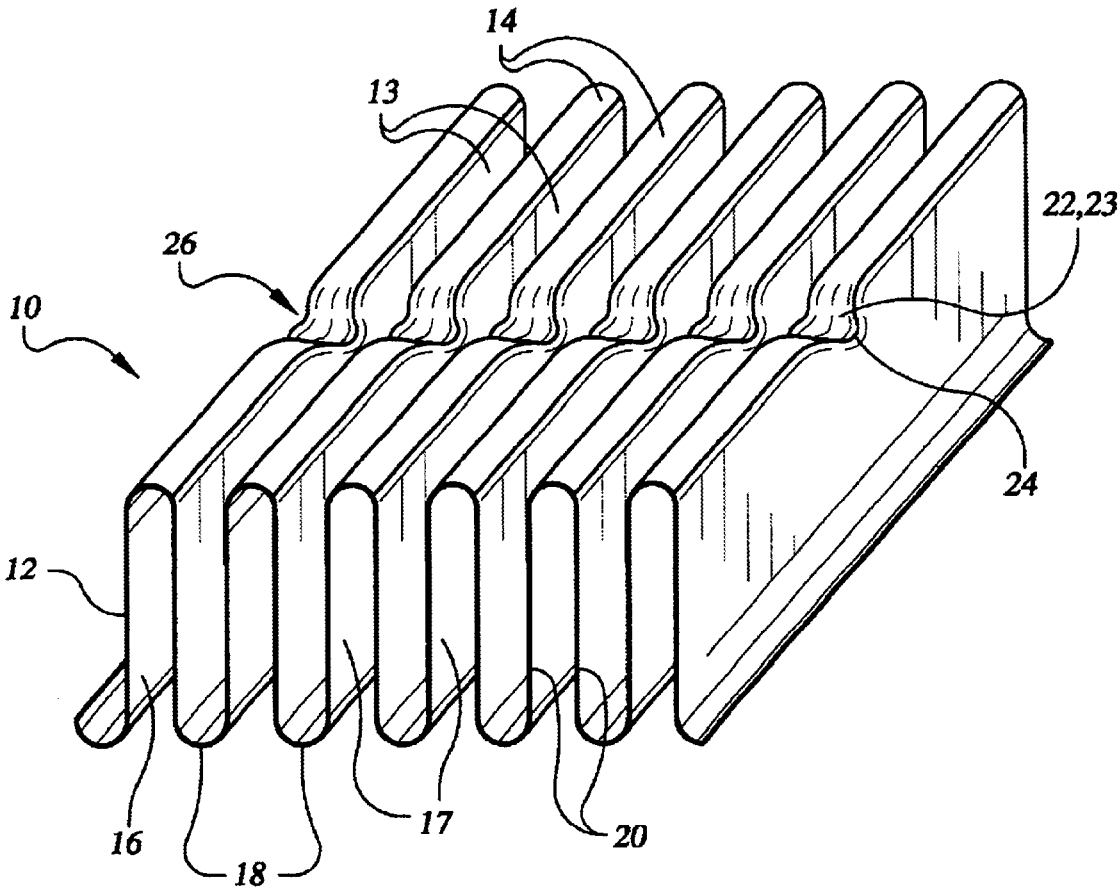
FIG. 1 is a perspective of a corrugated metal sheet formed with tube receiving channels.

Referring to FIG. 1, the corrugated metal sheet 10 is typically 4–20 mil thick, for example 10 mil thick aluminum having corrugations formed according to known methods. It may be a standard corrugated sheet of the type used for heat dissipation in automotive radiators. The sheet 10 has a first side 12 having first troughs 13 separated by first peaks 14, a second side 16 having second troughs 17 separated by second peaks 18, and parallel walls 20 separating the first troughs 13 from the second troughs 17. Each first peak 14 is formed with depressions 22 which are aligned with respective depressions in other first peaks to form channels 26 which extend transversely to the longitudinal direction defined by the peaks and troughs. Each depression 22 has an arcuate profile defined by a contact surface 23 which extends over each adjacent first trough 13 as a ledge 24 resulting from the forming process, as will be described. The contact surfaces 23 are typically formed with a cylindrical mandrel or mandrels of like size as the tube sections accommodated in the channels 26. The contact surfaces 23 conform to the tube sections in entirety to improve heat transfer to the corrugated sheet. The tube sections may be soldered or otherwise bonded to the corrugated sheet, and carry coolant from which heat must be dissipated. Note that the term tube section as used herein includes a heat pipe, or a solid body which conducts heat without a liquid.

Figure 2:
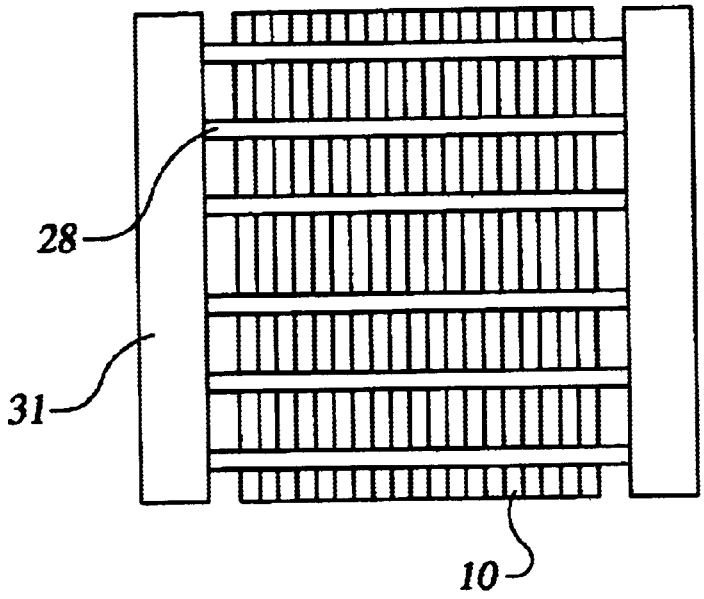
FIG. 2 is a plan view of a heat exchanger having tube sections connected to headers.

FIG. 2 shows a first embodiment of the heat exchanger according to the invention, wherein the tube sections 28 are connected to coolant headers 29 so that the coolant flows through the sections in parallel.

Figure 3:
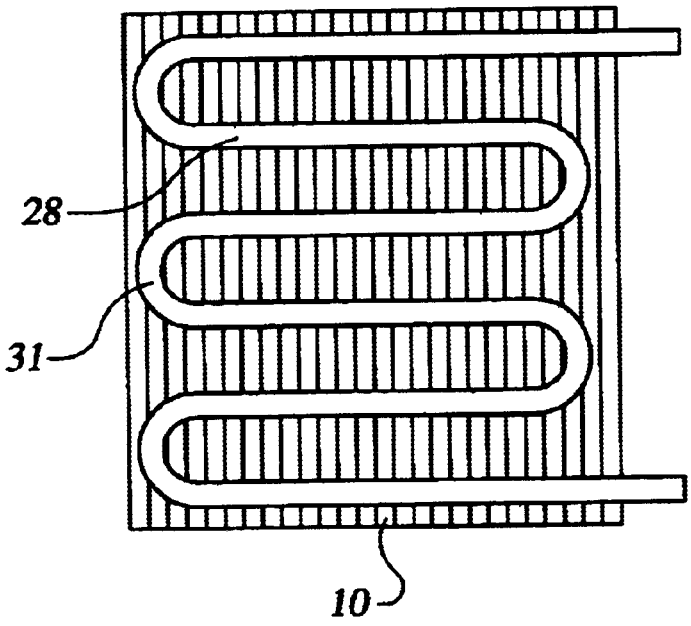
FIG. 3 is a plan view of the heat exchanger having tube sections connected in series to form a serpentine tube.

FIG. 3 shows a second embodiment of the heat exchanger according to the invention, wherein the tube sections 28 are connected in series by U-sections 31 to form a continuous serpentine tube.

Figure 4:
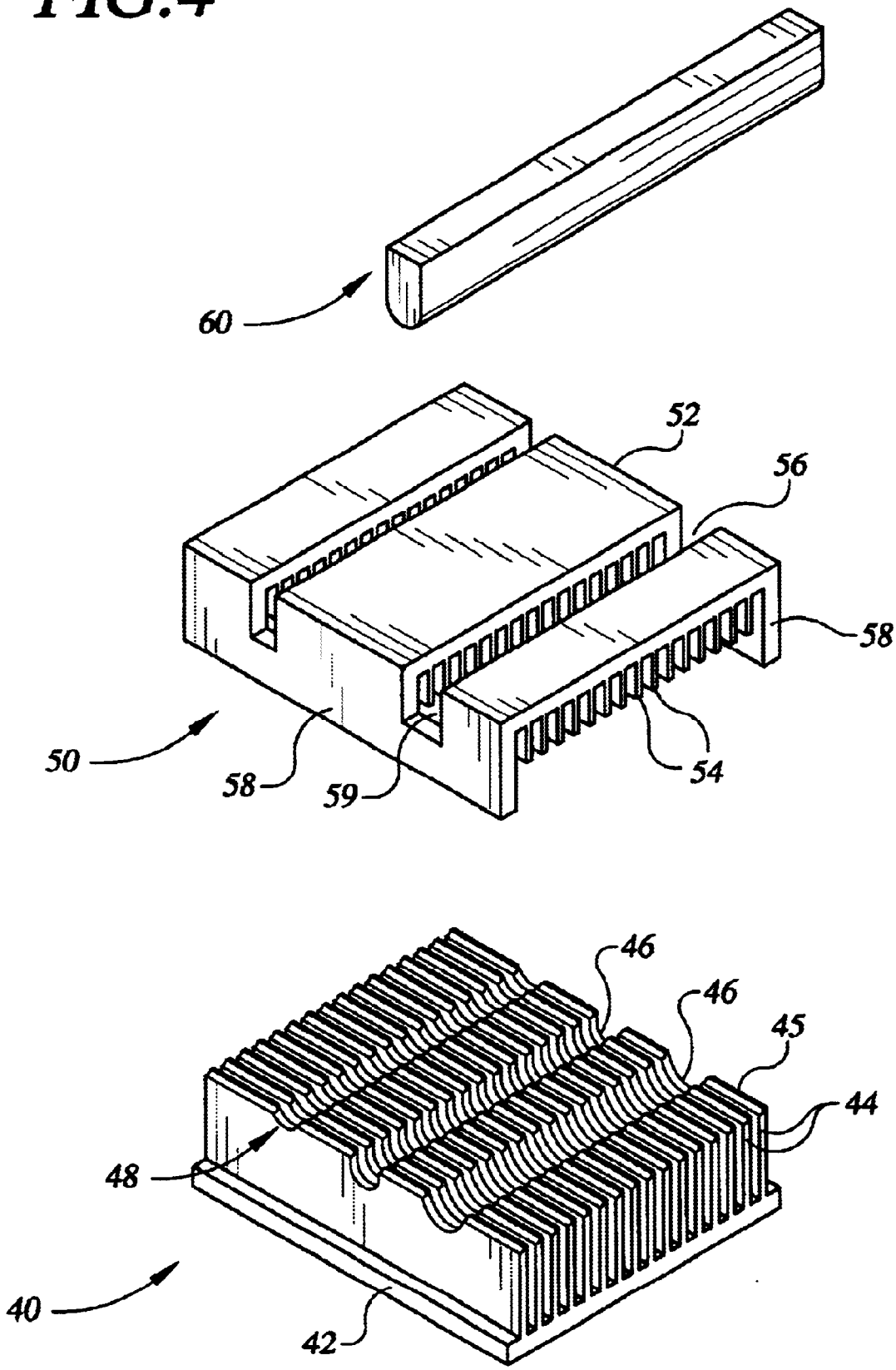
FIG. 4 is an exploded perspective of the fixtures used for forming the channels in the corrugated metal sheet.

FIG. 4 shows the first fixture 40, the second fixture 50, and the mandrels 60 which are used to form the channels 26 in the corrugated sheet 10. The first fixture 40 includes a base 42 to which first ribs 44 are fixed in parallel. The ribs may be manufactured separately and welded to the base, but the fixtures are preferably machined as integral units, preferably by EDM (electrical discharge milling) methods. Each first rib 44 has an edge 45 remote from the base, each edge being formed with notches 46, each notch 46 being aligned with notches in other first ribs to define forming channels 48. The notches 46 have an arcuate profile which substantially matches the profile of the depressions 22 to be formed in the corrugated sheet. The corners between the top edges 45 and the notches 46 are rounded to prevent damage to the sheet 10 when the depressions 42 are formed. The notches 46 are shown in different sizes for respective different channels for the purpose of illustration only; they will more typically all be the same size and profile.

The second fixture 50 includes a base 52 having parallel second ribs 54 welded or otherwise fixed thereto. Both the second base 52 and the second ribs 54 are interrupted to form windows 56 through which forming mandrels 60 can be received. Windows are sized according to the size of the corresponding channels 48 and mandrels 60. The second base 52 is therefore in sections which are fixed to sidewalls 58 in a bridging relationship. Each sidewall has notches 59 which are aligned with the windows 56.

In order to form the tube-receiving channels 26 in the in the corrugated sheet 10 (FIG. 1), the sheet 10 is placed on the first fixture 40 so that first ribs 44 are received in the second troughs 17, and the second peaks 18 rest on the base 42 between the first ribs. The edges 45 are preferably in proximity with the first peaks 14 but not in contact therewith, so that forming stresses will be compressive rather than tensile, which could induce tearing of the metal sheet.

After the corrugated sheet 10 is emplaced on the first fixture 40, the second fixture 50 is emplaced on the first fixture 40 with second ribs 54 extending into the first troughs 13 and the sidewalls 58 resting on the first base 42, the windows 56 being aligned with the forming channels 48. Each wall 20 of the corrugated sheet is therefore captured between a first rib 44 and a second rib 54, and thereby stabilized against lateral movement. The mandrel 60 is then moved downward into the windows 56 and pressed against the first peaks 14 of the corrugated sheet 10 to form the depressions 22 and ledges 24 which extend over adjacent troughs 13. The depressions and ledges define contact surfaces 23 which are aligned to form the channels 26 and are profiled to receive tube sections 28. Note that a single mandrel may be used repeatedly, or multiple mandrels may be fixed to a forming jig. The mandrels typically extend beyond the notches 59 in the sidewalls 58 of the second jig, which notches can be used to limit the downward travel of the mandrels. While use of a second fixture 50 is preferred, the principle of the inventive method may be achieved with only a first fixture 40 and an anvil or other vertically moveable mandrel means. However the second fixture provides lateral stability which limits the deformation of the peaks to a well defined area, which is also important when the depressions are formed with some lateral movement, as by a ball mill or other wiping mechanism.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A method of manufacturing a heat exchanger, comprising:

providing a corrugated metal sheet comprising a first side having a plurality of first troughs alternating with a plurality of first peaks, and a second side having a plurality of second troughs alternating with a plurality of second peaks, each said trough being formed by a pair of walls, each said wall separating said first side from said second side and extending from a first peak to a second peak, said troughs and said peaks extending in parallel and defining a longitudinal direction, providing a first fixture comprising a first base and a plurality of parallel first ribs fixed to said base, each said first rib having an edge remote from said base and at least one notch extending downward from said edge, said notches being aligned to form at least one forming channel extending transversely of said first ribs, placing said corrugated metal sheet on said first fixture so that said first ribs are received in said second troughs, forming said first peaks downward into said notches to form depressions which are mutually aligned to form at least one tube-receiving channel extending transversely to said longitudinal direction, each depression comprising a contact surface formed in said first side and extending laterally over each adjacent said first trough, and fixing a tube section in each said tube-receiving channel.

2. A method as in claim 1 wherein said edges of said first ribs are received against said second troughs.

3. A method as in claim 1 wherein each said notch has an arcuate profile, said first peaks being formed downward by at least one mandrel having a profile which is substantially similar to said profile of said notch.

4. A method as in claim 1 further comprising providing a second fixture comprising a second base and a plurality of parallel second ribs fixed to said second base, said second ribs and said second base being interrupted to form at least one window extending through said second fixture, and placing said second fixture onto said first fixture after placing said corrugated metal sheet on said first fixture and before forming said first peaks downward into said notches to form said depressions, said second ribs being received in said first troughs, said at least one window being aligned with said at least one forming channel, whereby, said first peaks can be formed downward and laterally to form said depressions by using at least one mandrel received through said at least one window in said second fixture.

5. A method as in claim 4 wherein said second fixture further comprises a pair of sidewalls fixed to said second base in parallel with said second ribs, each said sidewall having at least one notch which is aligned with said at least one window so that at least one mandrel extending beyond said sidewalls can be used to form said first peaks downward to form said at least one tube-receiving channel.

6. A method as in claim 1 wherein said peaks are formed downward using a mandrel.

* * * * *